US008402894B1

(12) United States Patent
McGuigan

(10) Patent No.: US 8,402,894 B1
(45) Date of Patent: Mar. 26, 2013

(54) BOAT PROPELLER ENTANGLEMENT APPARATUS AND MUNITION

(75) Inventor: Matthew T McGuigan, Knoxville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 148 days.

(21) Appl. No.: 13/093,921

(22) Filed: Apr. 26, 2011

Related U.S. Application Data

(60) Provisional application No. 61/352,848, filed on Jun. 9, 2010.

(51) Int. Cl.
*F42B 12/68* (2006.01)
*B63B 17/00* (2006.01)

(52) U.S. Cl. ..... 102/374; 102/504; 114/240 C

(58) Field of Classification Search ..... 102/504; 114/240 A–240 E, 241, 382; 43/7, 7.1, 9.1–9.95
See application file for complete search history.

(56) References Cited

U.S. PATENT DOCUMENTS

| | | | | | |
|---|---|---|---|---|---|
| 772,360 | A | * | 10/1904 | Jensen | 43/55 |
| 1,275,317 | A | | 8/1918 | Steams | |
| 2,300,565 | A | * | 11/1942 | Goloviznin | 340/852 |
| 2,353,360 | A | * | 7/1944 | Ronning | 244/1 R |
| 3,509,848 | A | * | 5/1970 | Salmon | 114/245 |
| 3,688,433 | A | * | 9/1972 | Niskin | 43/100 |
| 3,703,084 | A | | 11/1972 | Nugent | |
| 3,766,880 | A | * | 10/1973 | Ramsey et al. | 114/241 |
| 4,231,311 | A | * | 11/1980 | Longerich | 114/244 |
| 4,270,479 | A | * | 6/1981 | Baker et al. | 114/240 A |
| 4,637,155 | A | | 1/1987 | Johnson | |
| 4,768,417 | A | | 9/1988 | Wright | |
| 4,993,345 | A | * | 2/1991 | Feldman | 114/240 R |
| 5,069,109 | A | * | 12/1991 | Lavan, Jr. | 89/1.11 |
| 6,325,015 | B1 | | 12/2001 | Garcia et al. | |
| 6,394,016 | B2 | | 5/2002 | Swartout et al. | |
| 6,612,244 | B1 | * | 9/2003 | Grosch et al. | 102/402 |
| 6,877,456 | B2 | | 4/2005 | Metherell et al. | |
| 6,883,265 | B1 | * | 4/2005 | Jenssen | 43/9.1 |
| 7,165,502 | B2 | * | 1/2007 | Pedersen et al. | 114/255 |
| 7,441,511 | B2 | * | 10/2008 | Farinella et al. | 114/382 |
| 7,786,417 | B2 | * | 8/2010 | Sells, II | 244/3.1 |
| 8,245,617 | B2 | * | 8/2012 | Martinez et al. | 89/1.34 |
| 8,256,336 | B2 | * | 9/2012 | Larkin et al. | 89/1.11 |
| 2001/0032577 | A1 | * | 10/2001 | Swartout et al. | 114/254 |
| 2005/0016372 | A1 | | 1/2005 | Kilvert | |
| 2007/0017432 | A1 | * | 1/2007 | Farinella et al. | 114/382 |
| 2007/0133350 | A1 | * | 6/2007 | McDonald | 367/93 |
| 2009/0038530 | A1 | * | 2/2009 | Truong et al. | 114/382 |

(Continued)

FOREIGN PATENT DOCUMENTS

JP 2001147099 A * 5/2001

OTHER PUBLICATIONS

Simon Peaty, Maritime Vessel Stopping.
Barrier to Terror, U.S. Coast Guard.
The Boat Trap.

*Primary Examiner* — Bret Hayes
*Assistant Examiner* — Joshua Freeman
(74) *Attorney, Agent, or Firm* — Richard A. Morgan

(57) ABSTRACT

A compressed air launched munition comprises a projectile which after firing forms a multiplicity of elongated ropes held in a tubular configuration by a series of stiff spacers. The stiff spacers retain a rope tube diameter of at least about 8 inches. The ropes and stiff spacers have an essentially neutral specific gravity in water. The projectile is effective in entangling a boat propeller and stopping an uncooperative boat with little damage.

23 Claims, 2 Drawing Sheets

U.S. PATENT DOCUMENTS

2009/0114761 A1* 5/2009 Sells, II ..... 244/3.1
2010/0269675 A1* 10/2010 Larkin et al. ..... 89/1.11
2010/0300346 A1* 12/2010 Gayton ..... 114/382
2012/0110890 A1* 5/2012 Garrett ..... 43/55

* cited by examiner

FIG. 1
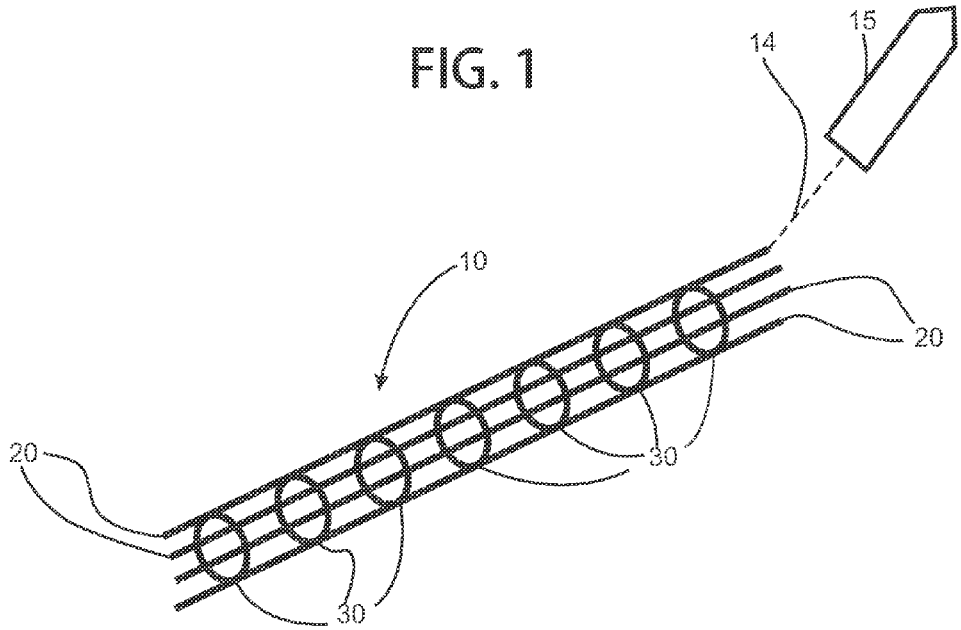
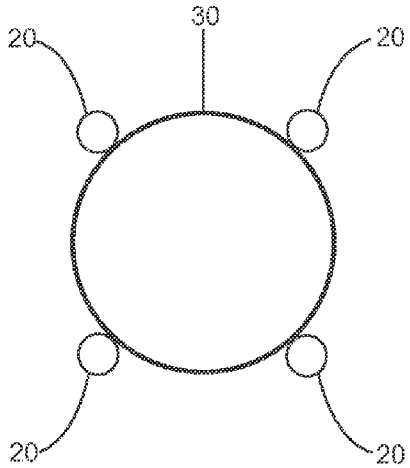
FIG. 2a
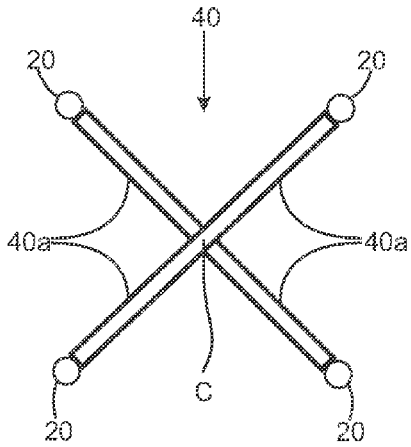
FIG. 2b

BOAT PROPELLER ENTANGLEMENT APPARATUS AND MUNITION

CROSS-REFERENCE TO RELATED APPLICATION

This application claims the benefit of U.S. Provisional Application No. 61/352,848, filed Jun. 9, 2010, which is incorporated herein by reference.

STATEMENT OF GOVERNMENT INTEREST

The invention described herein may be manufactured and used by or for the Government of the United States of America for governmental purposes without the payment of any royalties Thereon or therefor.

BACKGROUND OF THE INVENTION

1. Field of the Invention

The invention relates to rope apparatus for forcibly stopping a moving boat. The invention also relates to a method of fouling a boat propeller. The invention additionally relates to line throwing ordnance.

2. Discussion of the Related Art

Military and law enforcement authorities regularly stop boats for interrogation and inspection. Most stops are routine and the boat is released and sent on its way. Occasionally a boat crew will attempt to avoid the stop by fleeing. Flight from authorities is a primary indication that the boat carries contraband or is involved in other illegal activity. It is desirable for authorities to have the ability to stop, a fleeing boat without significantly damaging the boat or injuring the crew.

Nets or rope lines have been used against boats fleeing at high speeds of 50 knots or more. Launched munitions comprising folded rope lines have gained acceptance. In one apparatus presently in use, the primary elongated rope lines have been enhanced with many secondary rope loops. The munition is launched so that the fleeing boat passes over the unfolded, extended rope lines. The munition is successful when it contacts and entangles a boat propeller, stopping the boat.

Skill is required in deploying the munition because a fleeing boat may succeed in steering clear of rope lines. Also, a boat may pass over the rope lines, however, the present elongated ropes and loops are only about 60% successful in fouling a contacted propeller. Inboard motor boats with propellers that are spaced less from the hull than outboard motor boats are less susceptible to propeller fouling. Finally, large propellers may cut or shred the rope line or carry the rope line along without sufficient reduction in speed to allow capture.

SUMMARY OF THE INVENTION

A rope tube has proven effective for entangling a boat propeller. The rope tube comprises a multiplicity of ropes held on a tubular wall. The ropes are held in place annularly by a series of stiff spacers having a size to produce an elongated rope tube having a diameter of at least about 8 inches. The rope tube has a specific gravity that causes it to float, in water.

The apparatus is deployed as a barrier or folded to make a munition that is deployed by rocket launching. The apparatus is used against fast boats having outboard or inboard motors.

BRIEF DESCRIPTION OF THE DRAWINGS

A more complete appreciation of the invention and many of its attendant advantages will be readily appreciated as the same becomes better understood by reference to the following detailed description when considered in connection with the accompanying drawing wherein:

FIG. 1 is a perspective view of an apparatus of the invention.

FIG. 2*a* is a side view of a hoop shaped stiff spacer. FIG. 2*b* is a side view of a star shaped stiff spacer.

DETAILED DESCRIPTION OF THE INVENTION

Figure 3:
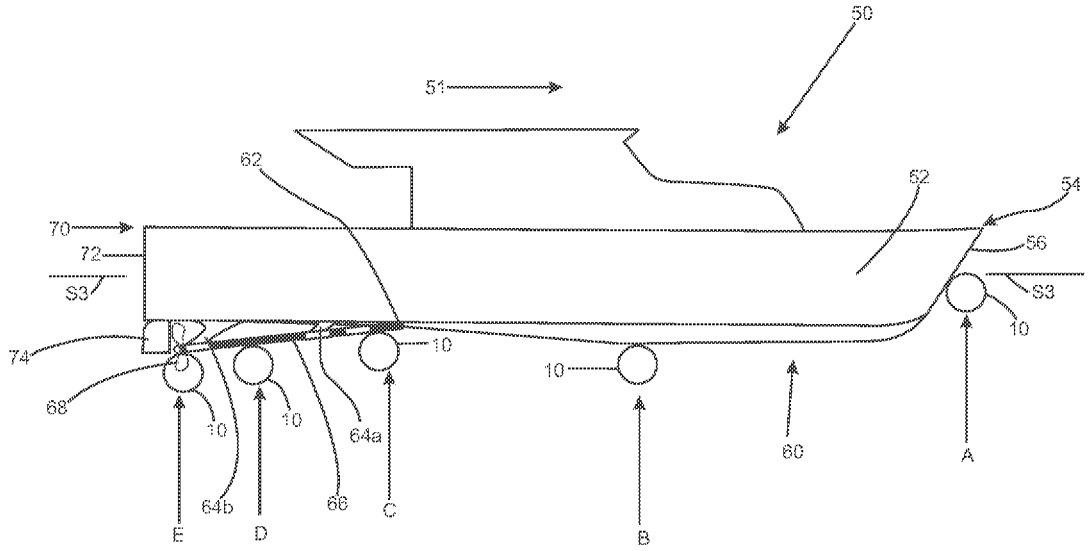
FIG. 3 is a side elevation and time lapse sequence of events of an inboard motor boat contacting an apparatus of the invention.

The invention is described with reference to the drawing wherein numerals in the written description correspond to like-numbered elements in the several figures. The drawing discloses a preferred embodiment of the invention and is not intended to limit the generally broad scope of the invention as set forth in the claims.

FIG. 1 is a view of a rope tube 10. Rope tube 10 comprises a plurality of elongated ropes 20 and stiff hoop shaped spacers 30. Four elongated ropes 20 are shown in this drawing. The preferred number ranges from 4 to 12 but the range can be increased if desired to enhance utility. The hoop shaped stiff spacers are positioned in a uniform series about 1 foot so 4 feet along the length of the rope tube 10. The length of the ropes is selected based on the range to be covered. If a barrier is to be erected, the length of the ropes is the length of the desired barrier and is not otherwise limited. A buoy may be attached to one or both ends to facilitate retrieval. If desired, position identification or warning buoys may be attached at intervals along the length. For use in a munition, the length of rope should be at least 30 feet in length and a length of 100 feet and greater can be selected based on experience to achieve a desired utility. For example a shorter length, e.g. 30 feet, may be selected to reduce weight and overall cost if the gunner's mate has the skill to hit the effective area into the apparent path of intended motion (PIM) of a fleeing boat and to land the elongated munition generally perpendicular to direction of travel. Gunner's mate does this by aiming and launching rocket 15 which is attached to the folded rope tube munition by attachment means 14.

FIG. 2*a* is a cross-sectional view of a stiff hoop spacer 30 with ropes 20 attached to form a tube, that is, the tubular wall. The generally circular hoop shape is preferred because it has been seen experimentally that it is particularly effective in contacting rope with the propeller. A hoop is light in weight and allows for the rope to be folded efficiently to form the munition. In another embodiment the muition is the folded rope tube and launching rocket. The folded rope tube is the munition. Attachment of the rope 20 to the stiff spacer 30 is accomplished with fastening means such as knotted string, knotted cords, plastic ties, plastic clips and the like. In FIG 1*b* is a cross-sectional view of a stiff star shaped spacer 40. In the drawing, the arms 40*a* of the star shaped stiff spacer 40 are of equal length, so that the pattern of attached, elongated ropes forms a tube, that is, the tubular wall. In addition, clips for attachment to the ropes 20 may be integrally formed with the arms 40*a*. The star shaped stiff spacer 40 may work particularly well in a smaller munition in which there are fewer ropes or ropes of lesser diameter. With larger number of ropes, the star shape may be less desirable because it requires the addition of an arm 40*a* for each rope 20 and therefore increases weight and complexity of assembly. A third variation is the combination of the FIG. 2*a* stiff spacer with the FIG. 2*b* stiff spacer.

Material—Ropes

In general, the ropes must be able to survive contact with a sharp, high speed boat propeller. That is, they have a breaking strength of at least 17,000 lbs. Ropes useful for the invention have strengths of 17,000 lbs to 100,000 lbs or more are commercially available. Rope diameters are ⅜-inch to 1-inch depending on the target boat. This rope weights 3 lbs/100 ft. to 22 lbs/100 ft. Rope is made by braiding multiple strands. The braiding is accomplished to leave a void in the core that can be filled with low density foam material to control buoyancy. This method of making denser polymer rope buoyant or buoyancy neutral in water is so common that the ropes are commercially available. Rope is available having a specific gravity of 0.9 and greater, preferably 0.96 to 1.1. The buoyancy is near neutral so that the rope floats at the surface in fresh water or salt water. In the alternative small buoys can be attached to control buoyancy.

Rope having the above described physical properties are made of high strength, flexible material, that is difficult to cut. Suitable materials include various commercially available synthetic fibrous materials. Such synthetic fibers include aramid polymers, polvaramid polymers and polyethylene polymers. The preferred ropes are made of super-fiber materials such as ultra high molecular weight polyethylene sold under the trademarks DEEMA® and SPECTRA®.

TABLE 1

KEVLAR ® para-aramid fiber 12-Strand single braided rope

| Diameter | Tensile Strength | Weight |
|---|---|---|
| 1/4 inch | 6,600 lbs | 2.0 lbs/100 ft. |
| 5/16 | 9,500 | 3.0 |
| 3/8 | 12,000 | 4.0 |
| 7/16 | 15,000 | 5.0 |
| 1/2 | 22,000 | 7.75 |
| 5/8 | 36,000 | 14.0 |
| 3/4 | 49,000 | 19.3 |
| 7/8 | 60,000 | 23.6 |
| 1 | 78,000 | 30.7 |

Specific Gravity 1.44
Elongation at Break 1.5% to 4.5%

TABLE 2

TECHNORA ® para-aramid fiber 12-Strand single braided rope

| Diameter | Tensile Strength | Weight |
|---|---|---|
| 1/4 inch | 8,000 lbs | 2.2 lbs/100ft. |
| 5/16 | 13,000 | 3.3 |
| 3/8 | 18,000 | 4.4 |
| 7/16 | 27,000 | 6.6 |
| 1/2 | 32,000 | 8.2 |
| 9/16 | 38,000 | 8.0 |
| 5/8 | 48,000 | 13.0 |
| 3/4 | 62,000 | 18.0 |
| 7/8 | 80,000 | 25.0 |
| 1 | 97,000 | 30.8 |

Specific Gravity 1.44
Elongation at Break 1.5% to 4.5%

TABLE 3

SPECTRA ® - modified ultra high density polyethylene fiber 12-strand single braided rope

| Diameter | Tensile Strength | Weight |
|---|---|---|
| 1/4 inch | 6,500 lbs | 1.7 lbs/100 ft. |
| 5/16 | 9,500 | 2.7 |
| 3/8 | 14,000 | 3.6 |
| 7/16 | 16,500 | 4.2 |
| 1/2 | 25,000 | 6.1 |
| 5/8 | 39,000 | 9.7 |
| 3/4 | 47,000 | 12.9 |
| 7/8 | 66,000 | 19.0 |
| 1 | 78,000 | 21.5 |

Specific Gravity 0.97
Elongation at Break 2.3% to 3.9%

TABLE 4

DYNEEMA ® ultra high molecular weight polyethylene fiber 12-Strand single braided rope

| Diameter | Tensile Strength | Weight |
|---|---|---|
| 1/4 inch | 8,400 lbs | 1.7 lbs/100 ft. |
| 5/16 | 13,200 | 2.6 |
| 3/8 | 19,000 | 3.6 |
| 7/16 | 23,800 | 4.6 |
| 1/2 | 31,000 | 6.5 |
| 9/16 | 38,000 | 8.0 |
| 5/8 | 51,000 | 10.0 |
| 3/4 | 67,000 | 16.5 |
| 7/8 | 30,000 | 19.5 |
| 1 | 110,000 | 23.0 |

Specific Gravity 0.97
Elongation at Break 2.3% to 3.9%

Rope materials with low breaking strengths are easily stretched on impact and cut by a propeller. These include materials such as NYLON®, polyester and cotton. For this reason, they are not recommended for use in the invention.

TABLE 5

12-Strand single braided polyester rope

| Diameter | Tensile Strength | Weight |
|---|---|---|
| 1/4 inch | 3,000 lbs | 2.0 lbs/100 ft. |
| 5/16 | 4,500 | 3.0 |
| 3/8 | 6,000 | 4.5 |
| 7/16 | 15,000 | 5.0 |
| 1/2 | 11,900 | 7.2 |
| 5/8 | 16,700 | 13.3 |
| 3/4 | 22,7000 | 16.5 |
| 7/8 | 30,000 | 23.4 |
| 1 | 35,000 | 32.5 |

Specific Gravity 1.38
Elongation at Break 15% to 20%

Material—Stiff Spacers

Materials useful for the stiff spacers include any of the materials that are stiff enough to maintain the shape of the apparatus and maintain stiffness and integrity after long exposure to sun and seawater and survive launching from a compressed gas munition launcher. Stiffness is about 1 inch of deflection/pound of force or less deflection/pound of force. In general these materials are referred so as marine polymers and include epoxy resins, low density polyethylene, high density polyethylene, polystyrene, NYLON® and polyethylene terephthalate. The stiff spacers may be made of composites of these materials. The composites may be reinforces with fiber materials such as glass fiber, carbon fiber, aramid polymer fiber (e.g. KEVLAR®) and copolymers of acrylonitrile and vinyl chloride (e.g. DYNEL®). These materials are exemplary of a wide variety of suitable materials used in a marine environment. Steel may also be used.

Munition

The munition is fabricated by folding the tube of rope and stiff spacers to form a compact munition. The compact munition may be covered to maintain compaction, folding and cleanliness. A cover also facilitates identification labeling, handling and storage.

The order of folding is carried out either from last stiff spacer to first, or the reverse. Rope tubes comprising hoop shaped spacers are advantageously folded with the rope within the hoops to produce a munition having a diameter not much greater than the hoop diameter. Rope tubes with star shaped spacers are folded with the rope outside the diameter of the star shape to produce a munition of greater diameter requiring a larger diameter launching tube. The munition has a specific gravity of 0.5 to 1.5.

The munition is launched by compressed gas rocket 15 in FIG. 1 from a launching tube having a diameter and length that contains the munition. Pulled by the rocket, the munition exits the firing tube in the folded configuration and extends to its full elongated configuration before landing in the water. Twisting and rolling should be avoided during folding because there is no additional means provided to untwist or unroll the rope tube once deployed. The rope tube can be folded so that it is in the effective three-dimensional configuration and fully functional immediately on landing. A small buoy may be attached so the munition to assist in retrieval. The propellant for the munition launching rocket 15 is compressed gas, such as compressed air, nitrogen or carbon dioxide. Compressed carbon dioxide has been used with success. In she alternative, she munition can be launched by line throwing ordnance or by hand.

Theory

Boat allisions with the apparatus of the invention were photographed and evaluated. Photographic films showed that the stiff spacers retained the relative three—dimensional configuration of the ropes as the boat hull passed over it. As a result, the three—dimensional structure successfully contacted and entangled boat propellers.

Criticality was discovered in the buoyancy of the apparatus. Particularly critical are the stiffness of the stiff spacers and most particularly the diameter of the stiff spacers.

First, the apparatus is buoyant or neutrally buoyant so that when a boat contacts the device, it rides along the bottom of the boat.

Second, the stiff spacers have to be stiff enough to hold the three-dimensional configuration of the rope tube as the boat passes over the apparatus. A boat contacting and passing over a propeller entanglement apparatus acts to collapse and distort the three-dimensional structure. It was found experimentally, that there is insufficient motive force and time for a collapsed or distorted rope entanglement tube to recover its shape before contacting the propeller. As a result, collapsed or distorted devices were less effective in contacting and entangling a propeller. Any entanglement device must retain its shape during transit under the boat until it contacts the propeller. The inventive rope tube apparatus was found to retain its shape. The spacers have a stiffness of about 1 inch of deflection/pound of force or less deflection/pound of force.

Third, it was found experimentally that the hydrodynamics around the propeller do not draw a rope apparatus to the propeller to cause entanglement. The rope tube apparatus of the invention was successful because the stiff spacers position the ropes at the proper distance below the boat bottom. That is, it was seen experimentally that as the rope tube lost contact with the boat bottom, at least some of the ropes were at propeller depth. The range of stiff spacer diameters is 8 inches to 36 inches to produce a rope tube of that diameter. The lower end of the stiff spacer diameter range, around about 8 is sized for smaller boats, particularly boats with outboard motors. The range of about 12 to 24 inches is sized for somewhat larger boats with outboard motors and boats of moderate size with inboard motors. The upper end of the range, about 24 to 36 inches, is sized for larger boats and particularly for inboard motor boats. Size of the target boat should be taken into consideration in selecting the munition.

Reference is made to FIG. 3 showing a side elevation and time lapse sequence of events A-E of inboard motor boat 50 traveling at surface S3 in the direction indicated by arrow 51 contacting a propeller entanglement rope tube 10. Boat 50 has a hull 52 with a fore end 54, a bottom 60 and an aft end 70. At the fore end 54 is bow 56. At the aft end 70 are stern 72 and rudder 74. On the bottom 60, in the stuffing box area 62 adjacent the aft rise in the keel line, a propeller shaft 66 protrudes from hull 52 and is supported and distanced from the bottom 60 by fore support bracket 64*a* and aft support bracket 64*b*. Propeller 68 is attached at the terminal end of propeller shaft 66.

The gunner's mate has fired a munition which has landed as an extended rope tube 10 one boat length or less ahead of a boat. Rope tube 10 extends a length of about 30 feet perpendicular to the direction the boat is headed. Rope tube 10 is shown in cross section. Event A shows the contact of the bow 56 with rope tube 10. The following event B shows the hull bottom 60 riding over the rope tube 10. Buoyancy causes rope tube 10 to remain in contact with hull 52 as the hull rides over it. Photographs of experiments described in the Example show that the inventive rope tube apparatus retains its three-dimensional shape while in contact with the bow and the hull. This is distinguished from here-to-fore used devices that collapse or distort on contact with the bow 56 or after riding under the hull bottom 60.

Event C shows rope tube 10 contacting the propeller shaft 66 in the stuffing box area 62. Event C shows rope tube 10 between bracket 64*a* and bracket 64*b* where it is separated and spaced from bottom 60. Again, rope tube 10 retains its three-dimensional configuration.

Event E shows rope tube 10 contacting propeller 68. This causes propeller to become entangled with rope and to stop rotating. It is essential to point, out that experiments have shown that the rope tube 10 has retained the same three-dimensional configuration from before event. A through event. E. The first event. A and the final event B event are separated by only moments and if the device had collapsed, there would have been no recovery time or motive force to cause a collapsed device to reorient to the original shape before Event A. It is also essential to note that the diameter of the tube caused some component ropes to be spaced from the bottom of the boat by an amount to contact the propeller 68.

Figure 4:
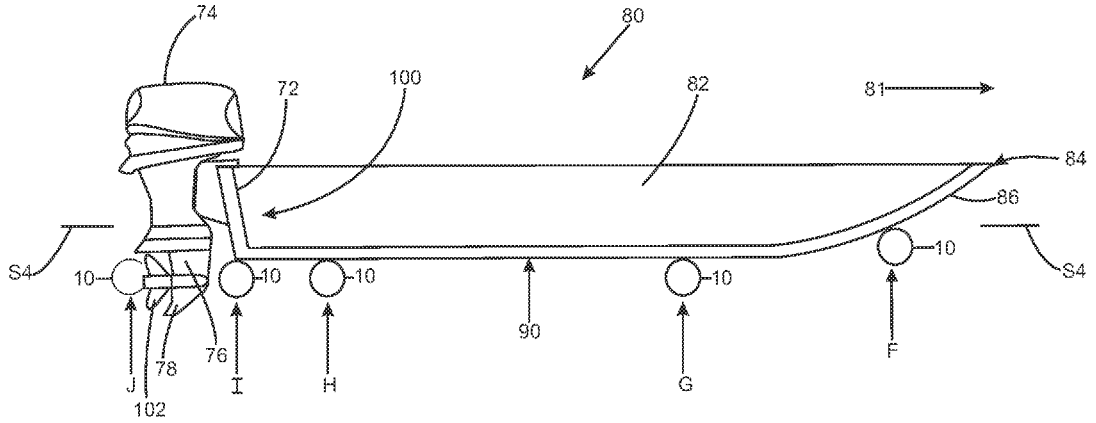
FIG. 4 is a side elevation and time lapse sequence of events of an outboard motor boat contacting an apparatus of the invention.

Reference is made to FIG. 4 showing a side elevation and time lapse of sequence of events F-J of a long-range outboard motor boat 30 traveling at the surface S4 in the direction indicated by arrow 81 and contacting a propeller entrapment rope tube 10. Boat 80 has a hull 32 with a fore end 34, a bottom 90 and an aft end 100. At the fore end 84 is bow 86. At the aft end 100 is the stern 72 to which is attached to a single outboard motor 74. Outboard motor 74 has a lower gear case 76 which terminates in a fin 78. Propeller 102 is driven by outboard motor 74.

A munition has landed rope tube 10 one boat length or less ahead of boat 80. Rope tube 10 extends a length of about 50 feet perpendicular to the direction the boat is heading. Rope tube 10 is shown in cross section. Event F shows contact of the bow 86 with rope tube 10. The following event G shows the hull bottom 90 riding over the rope tube 10. Buoyancy causes rope tube 10 to ride under the hull 82 while maintaining contact with hull 82. Photographs of experiments described in the Example show that the inventive device retains its three-dimensional shape in this position. This is distinguished from here-to-fore used devices that are collapsed or distorted on contact with the bow 86 or after riding under the hull bottom 90.

Event H shows rope tube 10 contacting the bottom 90 just before separation from hull 82. Rope tube 10 retains its three-dimensional configuration.

Event I shows rope tube 10 contacting fin 78. High speed film showed that this was immediately followed by event J where rope tube 10 contacts propeller 102. This causes propeller 102 to become entangled with rope and to stop rotating. It is essential to point out that experiments have shown that rope tube 10 has retained the same three-dimensional configuration from before event F through event J. The first event F and the final event J are separated by a moment and had device collapsed, there would have been no recovery time or guiding force that would have caused a collapsed device to reassemble to the original shape. It is also essential to note that the diameter of the tube caused component rope to be spaced from the bottom of the boat by an amount to contact ropes with the propeller 102.

This invention is shown by way of Example.

Example 1

The apparatus of the invention was tested to compare it with other rope line propeller entanglement devices, particularly the Running Gear Entanglement System (RGES) rope line device. The RGES device in munition form is described in U.S. Pat. No. 7,441,511 for a Watercraft Arresting System to M. D. Farinella at al. The configuration of the device in commercial use is a primary elongated rope with floats and secondary 40-inch pendant rope loops spaced by 8 inches. We tested variations in rope geometry, rope stiffness and buoyancy.

One device we tested was referred to as a ladder because it had two horizontally elongated rope sides and periodic perpendicular rope ties between the two elongated sides. The ladder device was the ROES device modified to eliminate spacing between adjacent loops. Adjacent loops were joined such that adjacent loops had a common secondary rope side. We tested variations, in geometry, buoyancy and weight.

A rope line propeller entanglement device tested included a single long rope. We tested variations in materials and buoyancy. We tested a single long rope with drogues. We tested variations in drogue chutes and weight.

Test runs are summarized as follows:

TABLE 6

| Type | Number of variations fabricated | Number of variations tested | Total number of runs |
|---|---|---|---|
| RGES | 10 | 6 | 69 |
| Single | 11 | 1 | 1 |
| Drogue | 9 | 9 | 19 |
| Ladder | 5 | 5 | 27 |
| Present Invention | 11 | 11 | 60 |
| Total | 46 | 32 | 176 |

Candidate propeller entanglement devices were tested in ¼-scale models. For validity, all relevant speed and length parameters were scaled using the dimensionless Froude number. Scale modeling was calculated for rope weight, buoyancy. Scaling was as follows

TABLE 7

| | Full Scale | 1/4 Scale |
|---|---|---|
| Hull length, feet | 40 | 10 |
| Hull beam, feet | 10 | 2.5 |
| Speed, knots | 40 | 20 |
| RPM at propeller | 3000 | 6000 |
| Motor Horsepower, (ft-lb)/sec | 250 | 1.95 |
| Torque at propeller, ft-lb | 430 | 2 |

We carried out testing at the Naval Surface Warfare Center, Carderock Division (NSWCCD) David Taylor Model Basin test facility in West Bethesda, Md. The test basin used is 2968 feet long and 21 ft. wide. The ¼-scale boat was towed through the water by an overhead carriage capable of speeds in excess of 50 knots. The tests were recorded with a high speed underwater camera system including cameras focused on the propellers from the back and from the side. The camera speed was 1000 frames per second. This camera speed was found to be sufficient to capture the sequence of events.

The hull shape of the representative fleeing boat was a U.S. Coast Guard Motor Life Boat (MLB) with twin Yamaha 200 HP outboard motors.

The speed range for the tests was 5 to 20 knots, with an emphasis on 5, 8, 12, 14 and 18 knots. It has been reported that some rope line entanglement munitions require a brief set up time to equilibrate time after being fired and hitting the surface of the water. It has also been reported that fast boats have avoided rope line entanglement munitions launched too far ahead of the boat. Three representative distances ahead of the boat were tested: (1.) immediately in front of the bow, (2) 20 feet in front of the bow, and (3.) ten feet in front of the bow.

One scaled boat length was ten feet.

Test results are summarized as follows:

TABLE 8

| Type | Number of attempts | Catch average | Entanglement Average | Average Entanglement Rate |
|---|---|---|---|---|
| RGES | 13 | 1.00 | 0.69 | 3.78 |
| Drogue | 5 | 1.00 | 0.60 | 3.33 |
| Ladder | 8 | 0.75 | 0.13 | 2.00 |
| Invention | 10 | 1.00 | 1.00 | 4.22 |
| Invention | 10 | 1.00 | 1.00 | 4.50 |
| invention | 15 | 1.00 | 0.93 | 3.86 |

Catch Average - Ropes contact propeller. The rope need not entangle propeller.
Entanglement Average - Entanglement based on number of attempts.
Average Entangle Rate - Test engineer's estimate of quality of entanglement in a range of 1 (least) to 5 (most).

Testing on the candidate single rope devices was discontinued because it was comparatively ineffective.

Comparative Example 2

Films of drogue chute designs were evaluated. It appeared that propeller hydrodynamics kept the drogue designs from successfully entangling the propeller. We modified the drogue chute design but were not able to appreciably improve performance.

Films of the ladder design were evaluated. The films show that the boat hull passed over the candidate device, collapsing it. The candidate device did not regain shape in the region of the propeller. As a result, the ladder design device experienced failures.

Films of the RGES design were evaluated. The films show that the boat hull passed over the candidate device, collapsing it. The candidate device did not regain shape in the region of the propeller. As a result, the RGES design device experienced failures.

Example 3

Films of the design of the invention were evaluated. They showed that the stiff spacers held the three-dimensional configuration ropes as the boat hull passed over it. As a result, the three-dimensional structure successfully contacted and entangled the propellers.

Criticality was discovered in stiffness and size of the spacers. First, the spacer had to be stiff enough to hold the three-dimensional configuration of the ropes as the boat passed over it. Stiffness is about 1 inch of deflection per pound or force or less deflection per pound of force. The ropes had to be in the design three-dimensional configuration in the region of the propellers. This implied that for a fast moving boat, the device has to hold its configuration through transit under the boat. There is insufficient time for a collapsed device to recover shape before contacting the propellers.

Second, the hydrodynamics around the propeller do not cause a device to be pulled in to cause entanglement. The apparatus of the invention was successful because the stiff spacers position the ropes at propeller depth. The stiff spacers provide a tubular diameter of 8 inches to 36 inches. This range was discovered experimentally. Diameters at the lower end of the range are sized for smaller boats with outboard motors. Diameters at the upper end of the range are sized for larger boats with inboard motors, e.g. boats up to 100 feet in length. The range around 24 inch diameters is used for she largest outboard motor boats and moderately sized inboard motor boats.

Example 4

Tube diameters less than 8 inches were tried on an outboard motor boat. A marked improvement in entanglement success exceeding 60% was seen when tube diameter was 8 to 10 inches and greater.

The foregoing discussion discloses and describes embodiments of the invention by way of example. One skilled in the art will readily recognize from this discussion, that various changes, modifications and variations can be made therein without departing from the spirit and scope of she invention as defined in the following claims.

What is claimed is:

1. A rope tube apparatus for entangling a boat propeller comprising: (a.) a multiplicity of ropes having a breaking strength of at least 17,000 pounds, the ropes held annularly such that each rope does not intersect on an elongated tubular wall by, (b.) a series of stiff spacers, the stiff spacers having a size to space the ropes and to hold them annularly on the tubular wall, the tubular wall having a diameter of at least about 8 inches, and (c.) the rope tube apparatus having a specific gravity of about 0.9 to about 1.1.

2. The rope tube apparatus of claim 1 wherein the stiff spacers are hoop shaped.

3. The rope tube apparatus of claim 1 wherein the stiff spacers have a stiffness of about 1 inch of deflection/pound of force or less deflection/pound of force.

4. The rope tube apparatus of claim 1 wherein the stiff spacers are hoop shaped and have a stiffness of about 1 inch of deflection/pound of force or less deflection/pound of force.

5. The rope tube apparatus of claim 1 wherein the elongated tubular wall has a diameter of 8 inches to 36 inches.

6. The rope tube apparatus of claim 1 wherein the elongated tubular wall has a diameter of 12 inches to 24 inches.

7. The rope tube apparatus of claim 1 wherein the elongated tubular wall has a diameter of 24 inches to 36 inches.

8. The rope tube apparatus of claim 1 wherein the multiplicity of ropes comprises 4 to 12 ropes.

9. A method of forcibly stopping a moving boat by entangling a propeller comprising:

(a.) deploying a floating rope tube apparatus in the path of the moving boat, the apparatus comprising:

(i.) a multiplicity of ropes held annularly on a tubular wall by, (ii.) a series of stiff hoop spacers, the stiff hoop spacers having a diameter of at least about 8 inches, (iii.) the rope tube apparatus having a specific gravity in the range of about 0.9 to about 1.1, (b.) allowing the moving boat to pass over the floating rope tube apparatus, thereby contacting and entangling the propeller, thereby stopping the boat.

10. The method of claim 9 wherein the stiff hoop spacers have a stiffness of about 1 inch of deflection/pound of force or less deflection/pound of force.

11. The method of claim 9 wherein the rope has a breaking strength of at least 17,000 pounds.

12. The method of claim 9 wherein the floating rope tube apparatus has a diameter of 8 inches to 36 inches.

13. The method of claim 9 wherein the floating rope tube apparatus has a diameter of 12 inches to 24 inches.

14. The method of claim 9 wherein the floating apparatus has a tubular cross sectional diameter of 24 inches to 36 inches.

15. The method of claim 9 wherein the multiplicity of ropes comprises 4 to 12 ropes.

16. A munition including a folded load which is unfoldable to form: (a.) a multiplicity of elongated ropes having a breaking strength of 17,000, the ropes held such that each ropes does not intersect in a tubular configuration by; (b.) a series of stiff spacers; and the load of elongated ropes and stiff spacers having a specific gravity of 0.5 to 1.5.

17. The munition of claim 16 wherein the stiff spacers have a hoop shape.

18. The munition of claim 16 wherein the rope has a specific gravity of 0.96 to 1.1.

19. The munition of claim 16 wherein the stiff spacers have a tubular cross sectional diameter of 8 inches to 36 inches.

20. The munition of claim 16 wherein the munition spacers have a tubular cross sectional diameter of 12 inches to 24 inches.

21. The munition of claim 16 wherein the stiff spacers have a tubular cross sectional diameter of 24 inches to 36 inches.

22. The munition of claim 16 wherein the multiplicity of ropes comprises 4 to 12 ropes.

23. The munition of claim 16 additionally including a launching rocket.

* * * * *